US008534721B1

(12) United States Patent
Boggs

(10) Patent No.: US 8,534,721 B1
(45) Date of Patent: Sep. 17, 2013

(54) CLOSURE RESTRAINT SYSTEM

(76) Inventor: John H. Boggs, Grove City, OH (US)

( * ) Notice: Subject to any disclaimer, the term of this patent is extended or adjusted under 35 U.S.C. 154(b) by 0 days.

(21) Appl. No.: 13/048,277

(22) Filed: Mar. 15, 2011

(51) Int. Cl.
*E05C 19/18* (2006.01)

(52) U.S. Cl.
USPC ..... 292/288; 292/296

(58) Field of Classification Search
USPC ..... 292/288, DIG. 17; 16/82
See application file for complete search history.

(56) References Cited

U.S. PATENT DOCUMENTS 1,176,859 A * 3/1916 Sautter ..... 292/298
2,889,571 A * 6/1959 Moore ..... 16/82
4,648,152 A * 3/1987 Grewall ..... 16/82
5,509,235 A * 4/1996 Chander ..... 49/383
5,680,675 A * 10/1997 Davis ..... 16/83
5,711,557 A * 1/1998 Nicolosi ..... 292/288
5,873,146 A * 2/1999 Mungo et al. ..... 16/82
6,244,636 B1 6/2001 Rissone
7,905,525 B2 * 3/2011 Badia ..... 292/262
2005/0046201 A1 * 3/2005 Patire et al. ..... 292/289

* cited by examiner

*Primary Examiner* — Kristina Fulton
(74) *Attorney, Agent, or Firm* — Ronald J. Koch

(57) ABSTRACT

A closure restraint system for providing security of an enclosed space by denying access into the interior of enclosed space or vice versa denying access to the exterior of the enclosed space. Access to said enclosed space is provided by some type of closure, typically a door, gate or access panel. The closure restraint system is mounted as and operates as a single unit with the second support plate being swiveled along the frictionally-restrained axis of the swivel shaft to the locked position with the closure closed. As the closure is attempted to be opened it is held ajar in the locked position; a line of sight or access cannot be obtained into or out of the enclosure; therefore, it does not allow the restraint system to be defeated.

9 Claims, 7 Drawing Sheets

CLOSURE RESTRAINT SYSTEM

BACKGROUND AND SUMMARY

The present invention relates to security of an enclosed space. Access to said enclosed space is provided by some type of closure, typically a door, gate or access panel.

Security is a broad term that generally means denying access into the interior of enclosed space or vice versa denying access to the exterior of the enclosed space. For interior access denial, one might deny access to a residence, apartment, business office or hotel room. Conversely, one might deny access to the exterior of an enclosed space when containing livestock in a corral, pen or other similar caged enclosure. For simplicity of further discussion, the focus will be relative to securing the interior of an enclosure under the auspice that the same discussion and principles apply equally to denying access to the exterior of enclosure.

Other inventions have endeavored to address the need for securing an enclosure. Yet, there remain disadvantages to these devices that are overcome by the present invention. Devices such as safety chains and swinging latches that allow access into the enclosed space allow said devices to be defeated by bolt cutters, hack saws or similar tools or devices to gain entry. Any device that allows access to itself may inherently be defeated. The present invention, while allowing the closure to be slightly ajar, does not allow access to the interior of the enclosed space, hence not allowing compromising access to the device to allow its operation to be defeated.

In addition, many of the other readily available devices or inventions have multiple individual components that are required to be mounted on both the closure and on the framework adjacent to the closure. In some of these multi-component cases, such as with sliding bolts with their adjacent receivers, safety chain devices or swinging latches, a function critical component is the alignment between these separately mounted components. The present invention is mounted as and operates as a single unit ensuring consistent operation without the potential for misalignment problems between functional components.

Further, the present invention's operation as a single unit makes it easy to install, easy and efficient to operate and furthermore has low manufacturing cost. This single unit design provides a low-profile operation and aesthetically pleasing design for any interior décor.

The present invention provides the about described needs and functions as well as others that become apparent to one skilled in the art based on the present invention's following detailed description.

REFERENCE NUMERALS IN DRAWINGS

Figure 1:
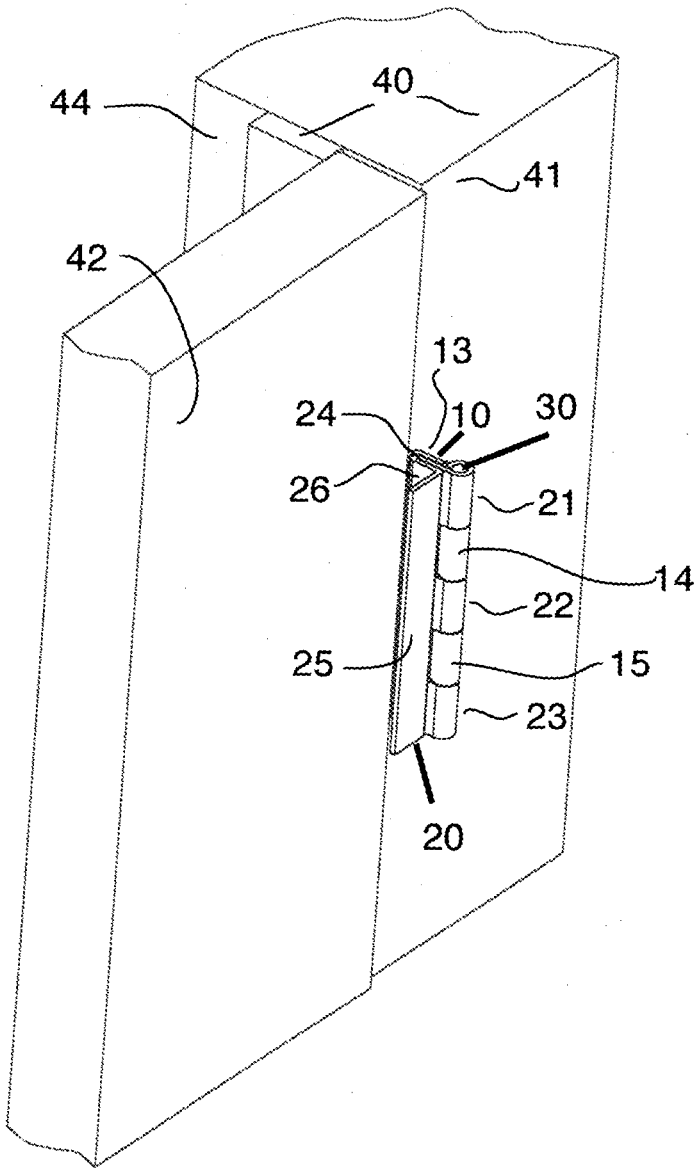
FIG. 1 is a perspective view of the closure restraint system in the locked position when the closure is closed.

| | |
|---|---|
| 10 | first support plate 10 |
| 11 | mounting portion 11 of first support plate |
| 12 | mounting apertures 12 of first support plate |
| 13 | first flange portion 13 of first support plate |
| 14 | first swivel knuckle portion 14 of first support plate |
| 15 | second swivel knuckle portion 15 of first support plate |
| 16 | shoulder portion 16 of first support plate |
| 20 | second support plate 20 |
| 21 | third swivel knuckle portion 21 of second support plate |
| 22 | fourth swivel knuckle portion 22 of second support plate |
| 23 | fifth swivel knuckle portion 23 of second support plate |
| 24 | second flange portion 24 of second support plate |
| 25 | third flange portion 25 of second support plate |
| 26 | locking face 26 of second flange portion |
| 30 | swivel shaft 30 |
| 40 | closure jamb 40 |
| 41 | interior edge of closure jamb 41 |
| 42 | closure 42 |
| 43 | closure edge 43 |
| 44 | medial surface of closure jamb 44 |

DETAILED DESCRIPTION

Now referring with particularity to the accompanying drawings, the reference numerals as stated above are consistent in indicating like parts throughout the views and referenced figures.

FIG. 1 is a perspective view of the closure restraint system, in the locked position, securely mounted mesially in relation to the closed closure 42 and closure jamb 40 on the medial surface 44 of closure jamb 40. The locked position is shown with the second flange portion 24 of second support plate 20 positioned against first flange portion 13 of first support plate 10. The first support plate 10, second support plate 20 and swivel shaft 30, as shown, are interconnected and operate as a single unit. There are no separate components that require mounting on closure 42, on closure jamb 40 or on interior edge 41 of said closure jamb 40.

Figure 2:
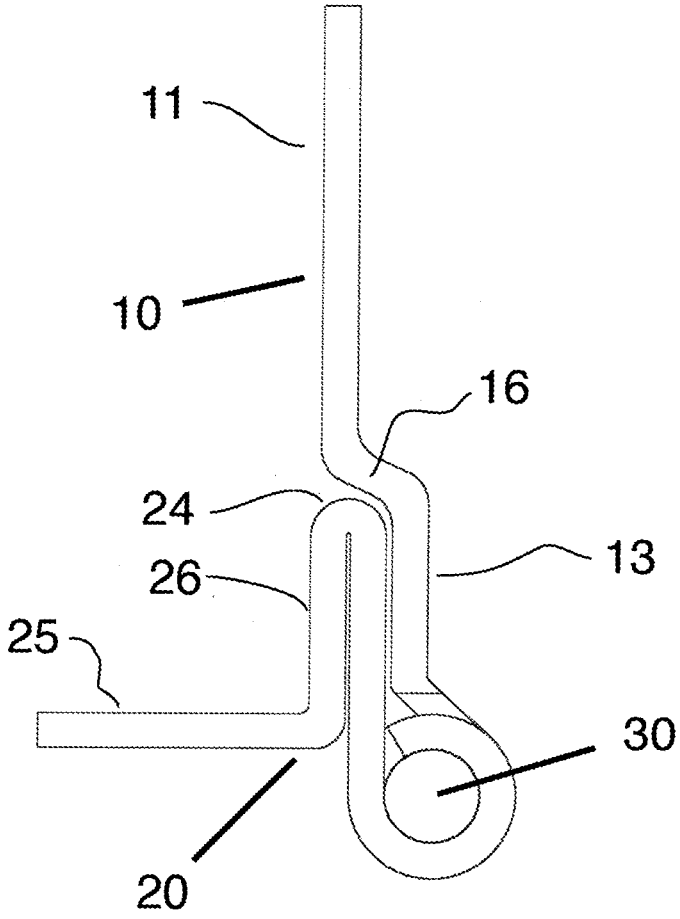
FIG. 2 is a plan view of the closure restraint system of FIG. 1.

FIG. 2 is a plan view of the closure restraint system. FIG. 2 illustrates one embodiment of first support plate 10 with its mounting portion 11 extending into shoulder portion 16, which allows second flange portion 24 of second support plate 20 to fit in a low-profile fashion against first flange portion 13 of first support plate 10. The locking face 26 of second flange portion 24 of second support plate 20 is not in the same plane as the surface of mounting portion 11 of first support plate 10. The swivel shaft 30 is shown in its axial relationship to first support 10 and second support 20 plates.

Figure 3:
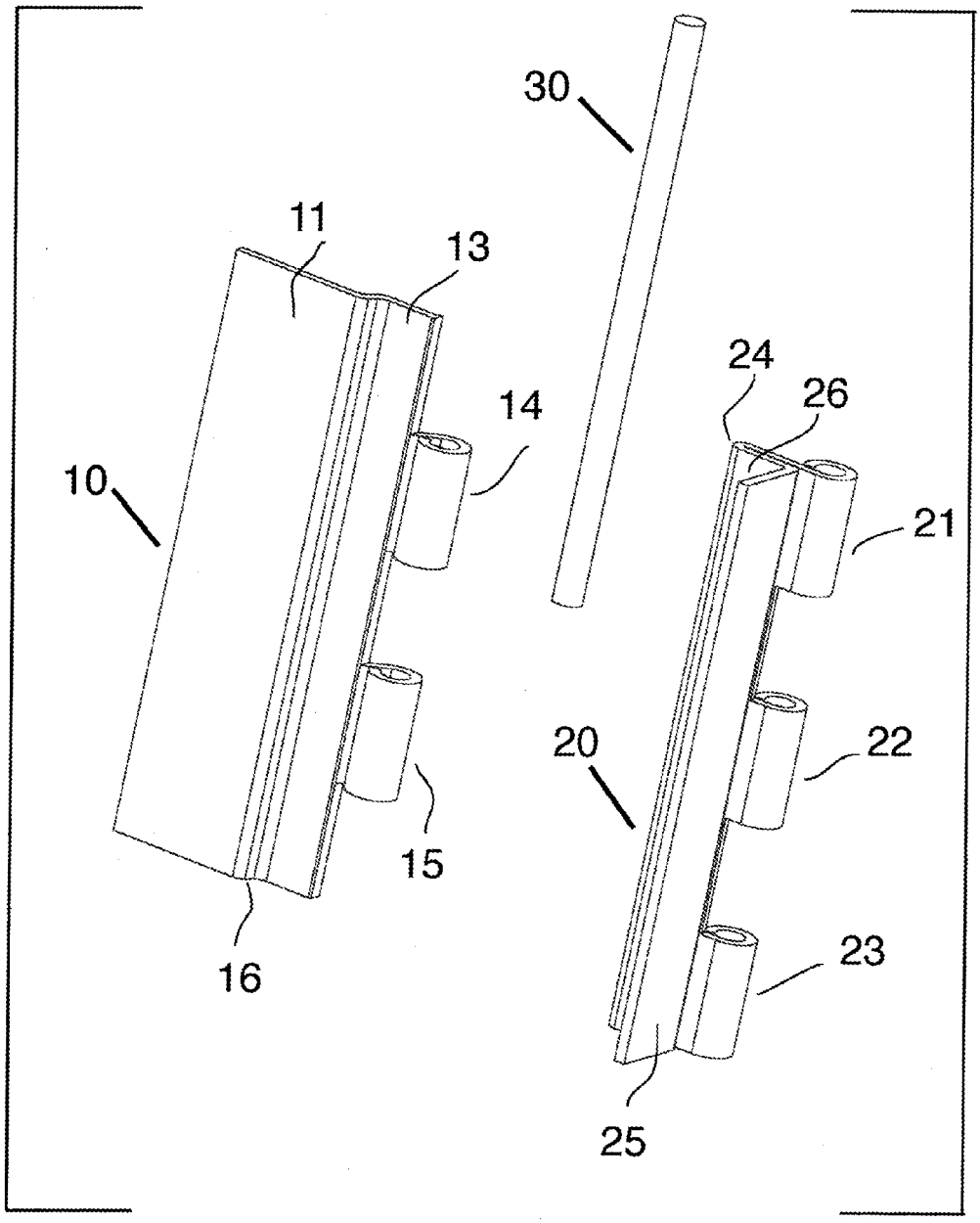
FIG. 3 is an exploded view of the closure restraint system of FIGS. 1-2.

FIG. 3 is an exploded view of the closure restraint system. FIG. 3 illustrates first support plate 10 with its mounting portion 11 extending to first flange portion 13. In one preferred embodiment, shoulder portion 16 is shown between mounting portion 11 and first flange portion 13. Extending from first flange portion 13 are first swivel knuckle portion 14 and second swivel knuckle portion 15.

FIGS. 1, 3, 6, & 7 illustrate the relationship and interconnection between first support plate 10 and second support plate 20 by the swivel shaft 30 extending between the first swivel knuckle 14 and second swivel knuckle 15 portions as staggered in relation to third 21, fourth 22, and fifth 23 swivel knuckle portions of second support plate 20. In preferred embodiments, either first support plate 10 or second support plate 20 has an odd number of swivel knuckle portions with a minimum of three said knuckle portions with the other support plate having an even number of swivel knuckle portions with a minimum of two said knuckle portions while maintaining a continuous and uniform staggered interconnection relationship between the swivel knuckles portions of both support plates. Such an arrangement provides added stability and reduces play between first 10 and second 20 support plates.

The swivel shaft 30 is semi-restrained by friction between itself and the swivel knuckle portions 14, 15, 21, 22, 23 of first 10 and second 20 support plates. In one embodiment, the frictional restraint is achieved between swivel knuckle portions 14, 15, 21, 22, 23 of first 10 and second 20 support plates by compressing the swivel knuckle portions 14, 15, 21, 22, 23 against each other axially along the length of the swivel shaft 30. The frictional restraint of the swivel shaft 30 serves to keep the second support plate in position whether in the locked or any unlocked position. Hence, if in an unlocked position, the second support plate will not freely swivel of its own accord to a position that interferes with the operation of the closure. This functionality of the invention precludes the potential for locking oneself out of the enclosed space by operation of the invention. In the locked position, the frictional restraint serves to maintain the locked position.

FIG. 2 also illustrates the relationship between second flange portion 24 and third flange portion 25 being adjacent to each other at 80° to 100° apart but most preferably at a 90° relationship.

Figure 4:
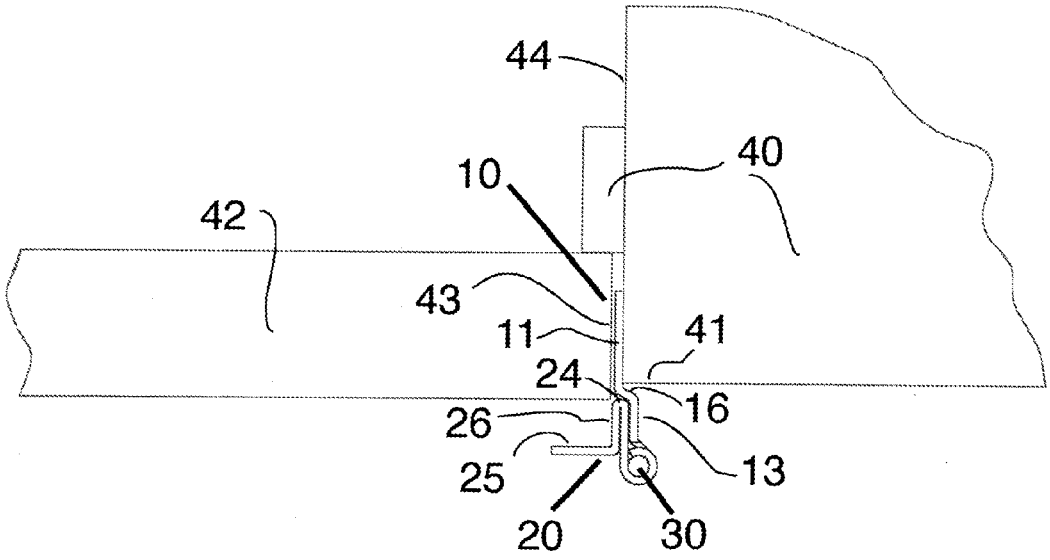
FIG. 4 is a partial plan view of the closure restraint system of FIGS. 1-3 illustrating the relationship of the closed closure and closure jamb to the restraint system in the closed position.

FIG. 4 is a partial plan view of the closure restraint system illustrating the relationship of the closed closure 42 and closure jamb 40 to the closure restraint system in the locked position. Mounting portion 11 of first support plate 10 is securely attached at the medial surface 44 of closure jamb 40. In one embodiment, shoulder portion 16 is form-fitting to the interior edge of closure jamb 41 providing a low-profile fit to closure jamb 40 and providing a recessed area along first flange portion 13 that acts as a stop for second flange portion 24 of second support plate 20 defining the locked position.

In one embodiment (best depicted in FIG. 4), mounting portion 11 of first support plate 10 is securely mounted to jamb 40 (using shims if necessary) to provide slight contact between closure edge 43 and locking face 26 of second flange portion 24 (in the locking position) as closure 42 opens and moves along locking face 26 of second flange portion 24. This contact provides added force against closure 42 to further restrain it from opening in addition to the restrictive force provided by third flange portion 25. In this embodiment, there is minimal clearance (but no contact) between closure edge 43 and the surface of mounting portion 11. Thus, locking face 26 is somewhat offset from said surface of mounting portion 11.

In one embodiment, incorporating shoulder portion 16 of first support plate 10, where the material of first 10 and second 20 support plates is 3⁄32 of an inch thick, mounting portion 11 of first support plate 10 is securely mounted to provide 3⁄32 of an inch clearance between itself and the closure edge. This allows the preferred slight contact between closure edge 43 and locking face 26 of the second flange portion 24 as closure 42 opens and moves along locking face 26 of second flange portion 24 and subsequently against third flange portion 25 with the closure restraint system in the locked position. It is preferred that the closure edge be parallel with third flange portion 25 when abutting against it in the locked position with the door slightly-ajar and being restrained.

Figure 5:
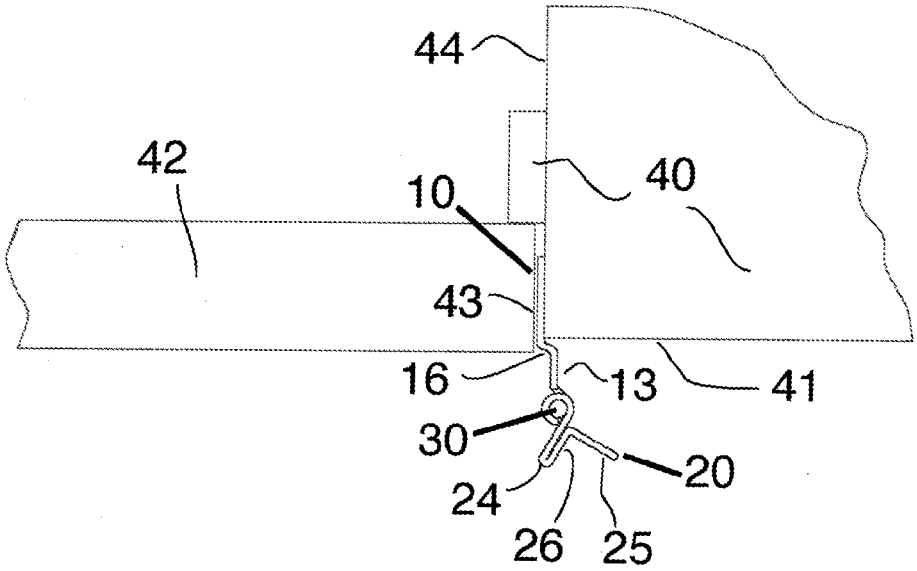
FIG. 5 is a partial plan view of the closure restraint system of FIGS. 1-4 illustrating the relationship of the closed closure and closure jamb to the restraint system in an unlocked position.

FIG. 5 is a partial plan view of the closure restraint system illustrating the relationship of the closed closure 42 and closure jamb 40 to the restraint system in an unlocked position. The second support plate 20 is swiveled around the axis defined by the swivel shaft 30 to an open position. An open position is any position of second support plate 20, which provides clearance between second support plate 20 and closure 42 allowing closure 42 to operate unimpeded by the closure restraint system. The second support plate 20 can swivel from the locked position greater than 230° relative to first support plate 10. In application, second support plate 20 will only be able to swivel to a maximum open position that is defined by its impedance with closure jamb 40 and more specifically with interior edge of the closure jamb 41.

Figure 6:
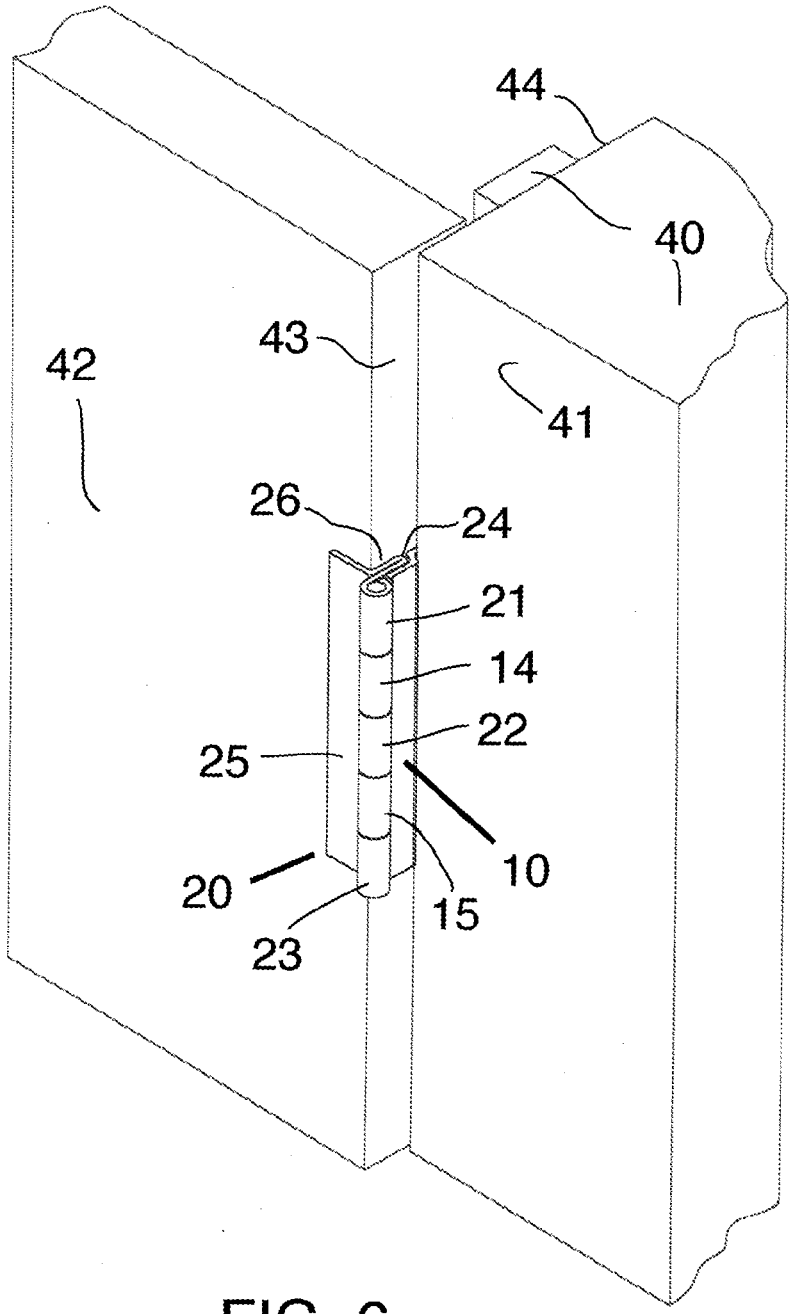
FIG. 6 is a perspective view of the closure restraint system of FIGS. 1-5 illustrating the relationship of the ajar closure and closure jamb to the restraint system in the locked position.

FIG. 6 is a perspective view of the closure restraint system illustrating the relationship of the slightly-ajar closure 42 and closure jamb 40 to the restraint system in the locked position. As closure 40 is attempted to be opened, closure edge 43 contacts and slides along locking face 26 of second flange portion 24 subsequently contacting third flange portion 25. Friction between swivel knuckle portions 14, 15, 21, 22, 23 and swivel shaft 30 prevent closure 42 from opening further. In addition, second flange portion 24 engages closure edge 43 as closure 42 slides along said locking face 26 of second flange portion 24 and as closure 42 engages third flange portion 25. The force of closure 42 opening as against third flange portion 25 is translated into engagement of second flange portion 24 into closure edge 43 as second support plate 20 attempts to rotate relative to the axis defined by swivel shaft 30.

As illustrated in FIG. 6, as the closure 42 is slightly-ajar and held in the locked position, a line of sight or access cannot be obtained into or out of the enclosure. This limited motion of closure 40, while the closure restraint system is in the locked position, does not allow access to the closure restraint system; therefore, it does not allow it to be defeated. Closure 42 can only be opened marginally allowing for communication to the other side without opening closure 42 completely or allowing a line of sight into or out of the enclosure.

Figure 7:
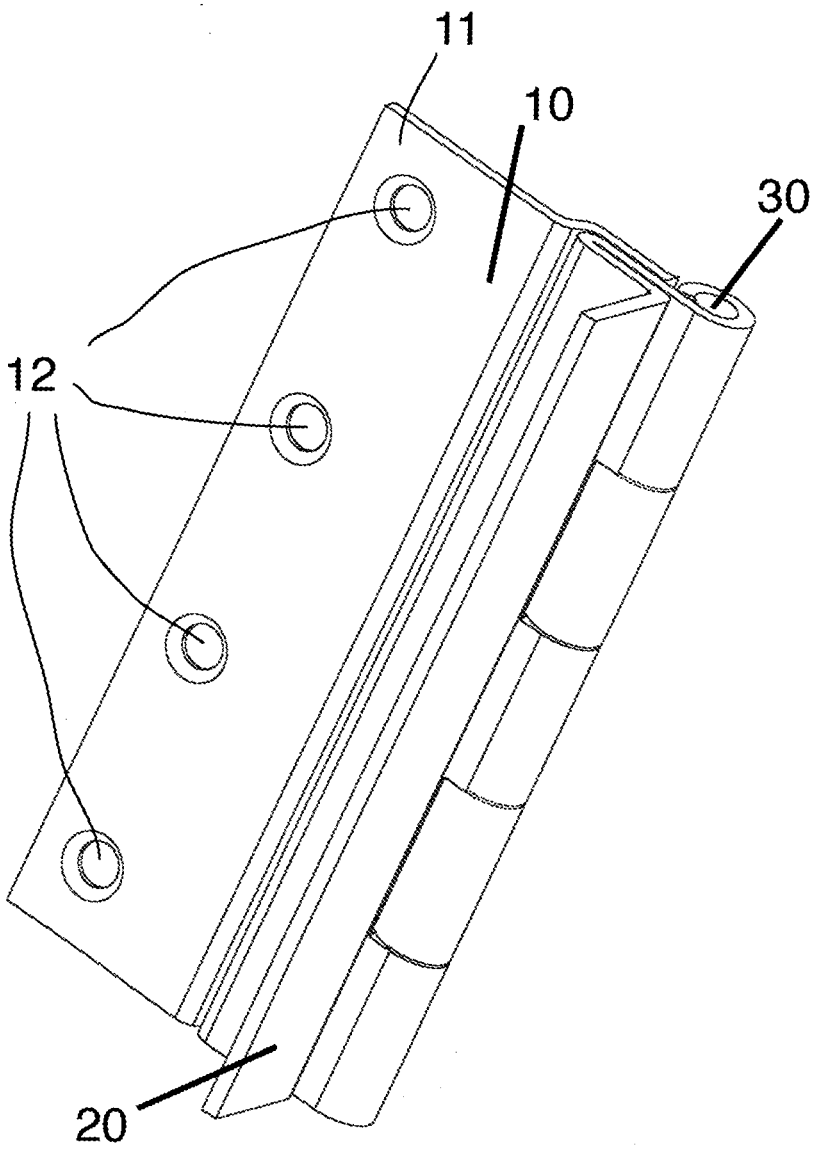
FIG. 7 is a perspective view of the closure restraint system of FIGS. 1-6 illustrating in an embodiment of this invention showing apertures for a mounting method.

FIG. 7 shows one embodiment of the enclosure restraint system with mounting apertures 12 along mounting portion 11 of first support plate 10. Secure mounting of the closure restraint system to closure jamb 40 can be accomplished by welding or other materials joining process or method or additionally, by some form of mounting hardware such as screws or bolts. The material of the closure restraint system itself is anticipated to be some type of material such as brass, aluminum, steel, stainless steel, nickel-based alloy, titanium or even plastic or composite that suites the required structural purpose and integrity whether said material is reinforced or not reinforced.

With the above disclosure, other features, details and modifications of the closure restraint system will become apparent to one skilled in the art. These aforestated features, details and modifications are considered a part of this invention as stated within the following claims.

The invention claimed is:

1. A closure restraint system comprising:

a first support plate secured mesially to a closure jamb near a closure edge, said first support plate including a plurality of swivel knuckle portions providing a cutout between said swivel knuckle portions;

a second support plate including a plurality of swivel knuckle portions staggered in relation to those of said first support plate swivelly connected to said first support plate by a swivel shaft extending between the swivel knuckle portions of said first support plate and those of said second support plate;

a second flange portion extending from said second support plate, wherein said second flange portion defines a locked position as it is swiveled in direct contact with a first flange portion of the first support plate;

whereby said second support plate swivels to the locked position, restraining a closure in a substantially closed position.

2. The closure restraint system of claim 1, wherein said second support plate, starting from the locked position swivels in a total range of motion greater than 230 degrees in relation to the first support plate.

3. The closure restraint system of claim 1, further including a means of preventing the second support plate from swiveling wherein said swivel knuckles maintain a friction lock against said shaft as the closure contacts a third flange portion of said second support plate.

4. The closure restraint system of claim 1, further including a means of preventing the second support plate from swiveling wherein said second flange portion engages the closure edge as a closure contacts a third flange portion of said second support plate.

5. The closure restraint system of claim 1, wherein said first support plate includes a shoulder portion to provide a low-profile fit for the first flange portion of the first support plate against the closure jamb.

6. The closure restraint system of claim 1, wherein said first support plate includes a shoulder portion providing a stop for the locked position and providing low-profile closure clearance for the second support plate.

7. The closure restraint system of claim 1, further including means to prevent the second support plate from swiveling as the closure passes the second flange portion contacting a third flange portion of the second support plate forcing engagement of the second flange portion into the closure.

8. A closure restraint system comprising:

first and second support plates;

and a swivel shaft;

the first support plate having, an essentially planar mounting portion, an essentially planar first flange portion being offset from the mounting portion by a shoulder portion, first and second knuckle portions, each being adjacent the first flange portion and distal from the mounting portion;

the second support plate having, an essentially planar second flange portion being substantially the same size as the first flange portion, third, fourth, and fifth knuckle portions, each being adjacent the second flange portion, a third flange portion adjacent the second flange portion, the second and third flange portions essentially having a cross-sectional L shape;

each of the first, second, third, fourth, and fifth knuckle portions being curled around a portion of the swivel shaft wherein the swivel shaft is semi-restrained by friction but can still rotate relative to the first and second support plates and further whereby the second support plate can move pivotally with respect to the first support plate;

the second flange portion being in direct contact with the first flange portion and the shoulder portion when the system is in a locked position.

9. A method of restraining a closure comprising the steps of:

providing the closure restraint system of claim 8; wherein, the first support plate is securely attached to a medial surface of a closure jamb such that the shoulder portion abuts an interior edge of the closure jamb, whereby the mounting plate is positioned between the medial surface of the closure jamb and a closed closure, and the second support plate can rotate between locked and unlocked positions with respect to the first support plate;

placing the closure restraint system in the locked position while the closure is closed;

whereby a closure being opened will engage the L shaped second and third flange portions and be restrained from further opening.

* * * * *